United States Patent [19]

Shulyak

[11] Patent Number: 4,586,730

[45] Date of Patent: May 6, 1986

[54] CLIPBOARD

[75] Inventor: Lev Shulyak, Worcester, Mass.

[73] Assignee: Shel Industries, Inc., Boston, Mass.

[21] Appl. No.: 615,316

[22] Filed: May 30, 1984

[51] Int. Cl.[4] ..... B42D 17/00; A47B 97/02

[52] U.S. Cl. ..... 281/45; 248/444

[58] Field of Search ..... 281/45, 46, 47, 48; 248/441 R, 442, 443, 444, 360, 205 R, 200; 40/110

[56] References Cited

U.S. PATENT DOCUMENTS

| | | | |
|---|---|---|---|
| 1,013,868 | 1/1912 | Dow | 281/45 |
| 1,317,423 | 9/1919 | Bottle | 248/444 |
| 1,539,393 | 5/1925 | Johnson | 281/45 |
| 1,908,874 | 5/1933 | Vanalstine | 248/441.1 |
| 2,271,294 | 1/1942 | Ford | 248/444 |
| 2,501,458 | 3/1950 | Walters | 281/45 |
| 3,378,941 | 4/1968 | Pollitt | 281/45 |
| 3,399,429 | 9/1968 | Goodman | 281/45 |
| 4,199,173 | 4/1980 | Greenlees | 281/45 |
| 4,264,049 | 4/1981 | Daniels | 248/444 |
| 4,329,799 | 5/1982 | Nagley | 40/110 |
| 4,333,626 | 6/1982 | Holbrook | 248/359 F |
| 4,375,296 | 3/1983 | Chang | 281/45 |
| 4,474,383 | 10/1984 | Kikis | 281/45 |

*Primary Examiner*—Paul A. Bell
*Assistant Examiner*—Paul M. Heyrana
*Attorney, Agent, or Firm*—Blodgett & Blodgett, P.C.

[57] ABSTRACT

A clipboard comprising a generally rectangular flat board for supporting a sheet of writing material, a clamp at the upper end of the board for holding the sheet of writing material and a flange extending outwardly from one edge of the board and having an aperture adapted to receive a users thumb for the purpose of holding the clipboard. The invention also consists of a clipboard having clamping means which consist of a roller mounted for rotation on support means at the top of the board for clamping a sheet of writing material to the board and for advancing the sheet along the upper surface of the board.

8 Claims, 5 Drawing Figures

CLIPBOARD

BACKGROUND OF THE INVENTION

The present invention relates generally to a writing board and more particularly to a clipboard which is a small writing board that has a spring clip at the top of the board for releasably holding papers or a writing pad.

Clipboards are used extensively by some individuals in many professions such as engineers and technicians and during inventory work. Clipboards are used primarily when an individual does not normally work at a fixed location but must move about from one location to another or work in an environment in which it is impossible to sit down at a writing table or desk. When the conventional clipboard is used for extended periods, fatigue develops from holding the clipboard. Normally the clipboard is either grasped at the top or side between the thumb and fingers or supported on the users forearm and steadied by the users hand. If the clipboard is grasp by the hand it must be held tightly. After a prolonged period of use the hand which does the grasping begins to tire. If the clipboard is supported on the forearm it is awkward to hold and unsteady and also leads to fatigue after a prolonged period of use. Another problem encountered in the use of the conventional clipboard is that as writing progresses from the top of the sheet to the bottom, the hand which holds the clipboard must be moved downwardly in transverse alignment with the writing hand to maintain maximum leverage. These and other difficulties experienced with the prior art clipboards have been obviated by the present invention.

It is, therefore, an outstanding object of the invention to provide a clipboard in which it is easy to hold the clipboard in one hand for long periods of time without fatiguing.

Another object of the invention is the provision of a clipboard which can be held in a balanced conditions by one hand so as to make the clipboard easy to hold and to use.

A further object of the present invention is the provision of a clipboard which has an improved clip that is capable of clamping and advancing the paper or pad along the surface of the board.

It is another object of the instant invention to provide a clipboard which is simple in construction, which is inexpensive to manufacture, and which is capable of a long life of useful service.

With these and other objects in view as will be apparent to those skilled in the art, the invention resides in the combination of parts set forth in the specification and covered by claims the appended hereto.

SUMMARY OF THE INVENTION

In general, the invention consists of a clipboard comprising a generally rectangular flat board having a clamp at the top for holding writing material and a flange extending outwardly from one edge of the board and having an aperture to permit insertion of a users thumb for grasping the clipboard. The invention also consists of a clipboard comprising a generally rectangular flat board for supporting writing material, support means at the upper end of the board and a roller mounted for rotation on the support means for clamping the writing material and for advancing the writing material along the surface of the board.

BRIEF DESCRIPTION OF THE DRAWINGS

The character of the invention, however, may be best understood by reference to ones of its structural forms, as illustrated by the accompanying drawings, in which.

DESCRIPTION OF THE PREFERRED EMBODIMENT

Figure 1:
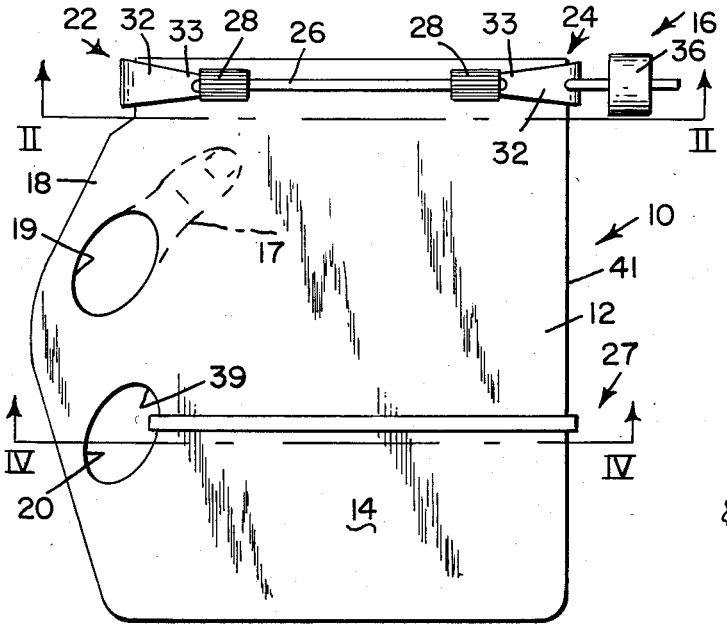
FIG. 1 is a top plan view of a clipboard embodying the principles of the present invention.
Figure 3:
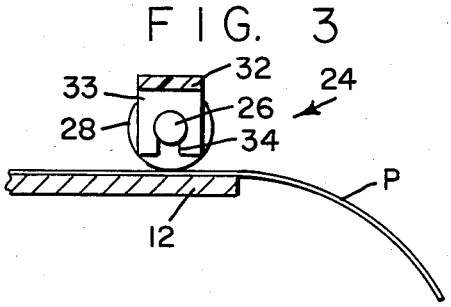
FIG. 3 is a vertical cross-sectional view taken on the line III—III of FIG. 2.
Figure 2:
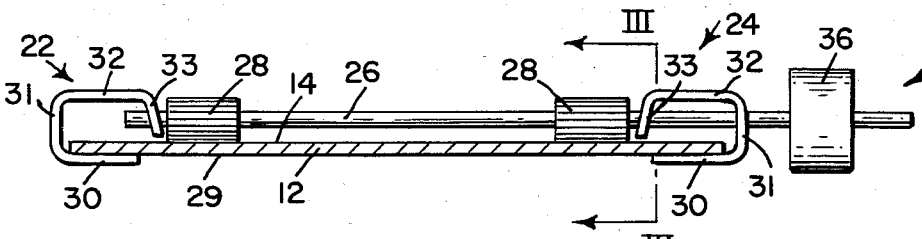
FIG. 2 is a vertical cross-sectional view taken on the line II—II of FIG. 1.

Referring to FIGS. 1–3 the clipboard of the preferred embodiment is generally indicated by the reference numeral 10 and comprises a flat rectangular board 12 having a flat top writing surface 14 and clamping means located at the top of the clipboard and generally indicated by the reference number 16. A flange 18 extends outwardly from one side of the board 12 and contains upper and lower apertures 19 and 20 respectively. Each of the apertures 19 and 20 is large enough to receive a user's thumb as shown by dot and dash lines in FIG. 1 and indicated by the reference numeral 17. The upper aperture 19 is utilized when writing near the top of the board and the lower aperture is used when writing occurs near the bottom of the board.

The clamping means 16 comprises a pair of feed rollers 28 which are fixed to a shaft 26. The shaft 26 is rotatably mounted on a pair of brackets, generally indicated by the reference numerals 22 and 24. Each of the brackets 22 and 24 comprises a lower horizontal portion 30 which is fixed to the lower surface 29 of the board 12, an outer vertical portion 31 an upper horizontal portion 32 and an inner vertical portion 33. Each of the brackets 22 and 24 is made of a resilient material such as spring steel or preferably plastic so that the rollers 28 are biased against the upper surface 14 of the board 12. The inner vertical portion 33 of each bracket includes a vertical "keyhole" shaped slot 34 as shown in FIG. 3 for receiving the shaft 26 in a snap fit. This feature facilitates the assembly and disassembly of the clamping means 16. A circular knob 36 is fixed to one end of the shaft 26 which extends beyond the bracket 24 as shown in FIGS. 1 and 2 for rotating the shaft 26 about its longitudinal axis. The outer surface of each of the rollers 28 is preferably fluted and the roller preferably made of a elastomeric material to provide better gripping of the writing material which is placed between the rollers and the upper surface 14 of the board 12.

The clipboard 10 is also provided with a hold-down bar generally indicated by the reference numeral 27. The hold-down bar 27 comprises a straight portion 35 and a pair of leg portions 37 at opposite ends of the straight portion 35. The hold-down bar 27 is made of a resilient material such as plastic or steel and the leg portions 37 are curved. This allows the hold-down bar to be applied to the clipboard 10 for a snap fit from the inner edge on one of the apertures 19 or 20 to the opposite side edge of the clipboard as shown in FIG. 1. The inner edge of aperture 20 is indicated by the reference numeral 39 and the opposite side edge of the clipboard is indicated by the reference numeral 41.

The operation and advantages of the present invention will now be readily understood in view of the above description. The clipboard 10 of the present invention is utilized by placing writing material such as pages or a pad on the surface 14 of the board 12 so that the top portion of the writing material is located beneath the rollers 28. This holds the writing material firmly on the board 12. The clipboard 10 is held in one hand by placing the thumb through one of the apertures 19 and 20 so that the bottom of the board is supported on the fingers of that hand. In this way the board 12 is firmly supported without the need of grasping the board between the thumb and fingers as in the case of conventional prior art clipboards. Since the clipboard is held solely by the hand and does not need to be supported by the forearm the clipboard is easily manuvered to different positions relative to the user in order to adapt to different writing situations. Normally, the upper aperture 19 is used when writing occurs near the top portion of the board and the aperture 20 is used when writing occurs near the bottom of the board. The board 10 shown in FIGS. 1–3 is designed for a right handed person, wherein the left hand is used for holding the board 12 and the right hand is used for writing. For a left handed person, the configuration of the clipboard 10 would be a mirror image of that which is shown in FIG. 1. It is also preferred that the upper surface 14 consists of an erasable writing surface such as white plastic which can be written on by a grease pencil or the like. The clamping means 16 enables the writing material to be advanced upwardly along the surface 14 as writing progresses from the top of the writing material to the bottom. In this way, the clipboard can always be held near the top by utilizing the aperture 19 and the paper or pad periodically advanced so that the point of writing always occurs adjacent the aperture 19. This features also enables a pad or paper which is longer than the clipboard to be fully utilized.

The hold-down bar 35 is removed from the clipboard before writing material is applied to the clipboard. The hold-down bar is then re-applied to the clipboard by forcing the leg portions 37 over the inner edge 39 of the aperture 20 and the opposite side edge 41 so that the writing material is clamped between the hold-down bar 27 and the writing surface 14. The hold-down bar can also be applied to the back of the clipboard so that it extends from the aperture 19 to the side edge 41, if for example, a pad is being used, the top sheet can be brought over the clamping means 16 and tucked between the bar 27 and the back surface of the clipboard.

MODIFIED CLIP BOARD

Figure 4:
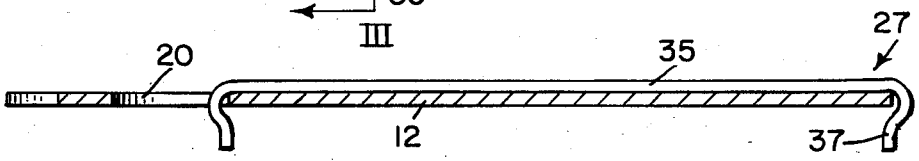
FIG. 4 is a vertical cross-sectional view taken on the line IV—IV of FIG. 1.
Figure 5:
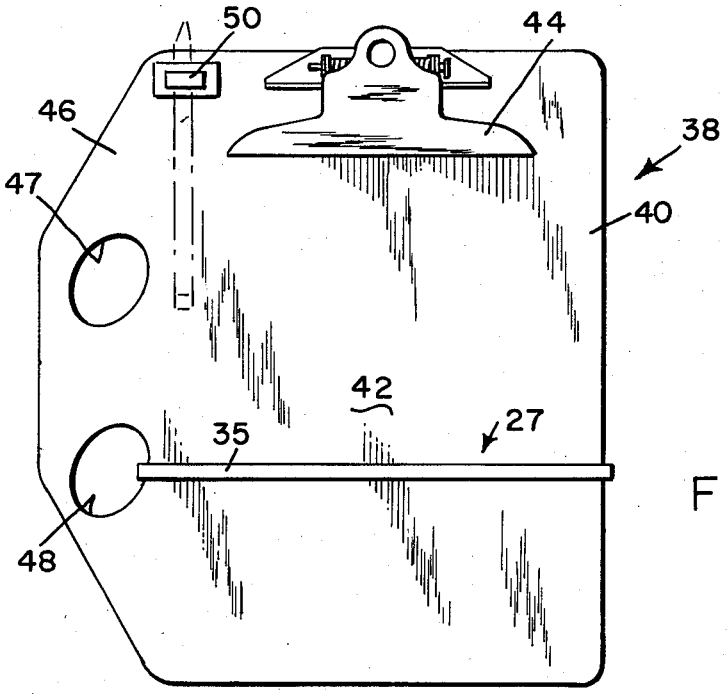
FIG. 5 is a top plan view of a modified clipboard.

Referring to FIG. 4 there is shown a modified clipboard generally indicated by the reference numeral 38 which comprises a flat generally rectangular board 40 having a flat upper surface 42. The clipboard 38 includes a conventional spring loaded clip 44 for clamping the top of writing material which is placed on the surface 42 and holding it in place for writing. A flange 46 extends outwardly from one side of a board 40 and contains upper and lower eliptical apertures 47 and 48 respectively. Each of the apertures 47 and 48 is adapted for receiving the users thumb in the same manner as apertures 19 and 20 for enabling the user to hold the clipboard effortlessly in one hand. The clipboard 38 is used by placing the writing material such as a sheet of paper or pad on the surface 42 so that the upper portion of the pad is clamped between the clip 44 and the surface 42. The clipboard is held by inserting the thumb of the left hand through the aperture 47 so that it rests on the surface 42 and the bottom of the board 40 rests on the fingers of the same hand. When the top of the page is filled with writing, the user's left hand can be shifted so that the left thumb is inserted through the aperture 48 so that the point of support is adjacent the point of writing. A pencil holder 50 is located at the top of the board adjacent the clip 44 to provide convenient storage of the pencil between periods of writing.

The hold-down bar 27 can also be used with the clipboard 38 in the same manner as for the clipboard 10.

It is obvious that minor changes may be made in the form in construction of the invention without departing from the material spirit thereof. It is not, however, desired to confine the invention to the exact form herein shown and described, but it is desired to include all such as properly come within the scope claimed.

The invention having been thus described what is claimed as new and desired to secure by Letters Patent is:

1. Clipboard comprising:

(a) a generally rectangular flat board having a top edge, a bottom edge, a first side edge, and a flat upper surface for supporting a sheet of writing material, (b) a clamp mounted on the top surface at the upper end of the board for holding the sheet of writing material on said surface, (c) an outwardly extending flange having a second side edge which is opposite said first side edge and having an aperture adapted for receiving a user's thumb for holding the clipboard, said second side edge and said aperture being substantially outside of the area of said upper surface which extends between said top and bottom edges and, (d) a hold-down bar which is removably attached to said clipboard so that it extends from said aperture to the opposite side edge of said clipboard.

2. Clipboard as recited in claim 1, wherein said aperture is eliptical.

3. Clipboard as recited in claim 1, wherein a second aperture is located in said flange and is spaced from the first aperture.

4. Clipboard as recited in claim 1, wherein a pencil holder is located on said top surface adjacent the clamp.

5. Clipboard as recited in claim 1, wherein said clamp comprises roller means for clamping and advancing the sheet of writing material along said upper surface.

6. Clipboard as recited in claim 1, wherein said upper surface consists of substantially white plastic adapted for being written on by a conventional erasable grease pencil.

7. Clipboard as recited in claim 1, wherein said bar comprises:

(a) an elongated straight portion adapted to extend across the surface of the clipboard from the aperture to said opposite side edge, (b) a first leg portion at one end of said straight portion which is adapted to engage the inner edge of said aperture, and (c) a second leg portion at the opposite end of said straight portion which is adapted to engage said opposite side edge.

8. Clipboard as recited in claim 7, wherein said bar is made of a resilient material and said first and second leg portions are curved and engage their respective edges in a snap fit.

* * * * *